US011798494B2

(12) United States Patent
Jiang et al.

(10) Patent No.: US 11,798,494 B2
(45) Date of Patent: Oct. 24, 2023

(54) OLED DISPLAY DEVICE AND BRIGHTNESS DRIVING METHOD THEREOF

(71) Applicant: WUHAN CHINA STAR OPTOELECTRONICS SEMICONDUCTOR DISPLAY TECHNOLOGY CO., LTD., Wuhan (CN)

(72) Inventors: Kaiyun Jiang, Wuhan (CN); Yuan Wu, Wuhan (CN)

(73) Assignee: WUHAN CHINA STAR OPTOELECTRONICS SEMICONDUCTOR DISPLAY TECHNOLOGY CO., LTD., Wuhan (CN)

( * ) Notice: Subject to any disclaimer, the term of this patent is extended or adjusted under 35 U.S.C. 154(b) by 0 days.

(21) Appl. No.: 17/771,478

(22) PCT Filed: Mar. 8, 2022

(86) PCT No.: PCT/CN2022/079663
§ 371 (c)(1),
(2) Date: Apr. 24, 2022

(65) Prior Publication Data

US 2023/0260466 A1 Aug. 17, 2023

(51) Int. Cl.
*G09G 3/3291* (2016.01)
*G09G 3/3258* (2016.01)
(Continued)

(52) U.S. Cl.
CPC ..... *G09G 3/3291* (2013.01); *G09G 3/3258* (2013.01); *G09G 3/3208* (2013.01);
(Continued)

(58) Field of Classification Search
CPC .. G09G 3/3291; G09G 3/3258; G09G 3/3233; G09G 3/3208; G09G 2300/0819; G09G 2320/0626; G09G 2320/0233
(Continued)

(56) References Cited

U.S. PATENT DOCUMENTS

2006/0038758 A1* 2/2006 Routley ..... G09G 3/3233 345/81
2008/0170014 A1* 7/2008 Jung ..... G09G 3/3233 345/82
(Continued)

FOREIGN PATENT DOCUMENTS

CN 108847184 A 11/2018
CN 110111735 A 8/2019
(Continued)

OTHER PUBLICATIONS

Chinese Office Action issued in corresponding Chinese Patent Application No. 202210139962 X, dated Jan. 28, 2023, pp. 1-8, 20pp.

*Primary Examiner* — Tom V Sheng
(74) *Attorney, Agent, or Firm* — The Roy Gross Law Firm, LLC; Roy Gross

(57) ABSTRACT

An organic light emitting diode display device and a brightness driving method thereof are disclosed. The display device includes a display brightness value adjustment unit configured to adjust a display brightness value within a predetermined display brightness value interval and a data driving unit configured to receive a display brightness value and output different data voltages according to whether the display brightness value is equal to a display brightness value configured to correspond to a voltage switch point of a predetermined cathode voltage interval such that a brightness difference between any adjacent two of display brightness value is within a predetermined range.

18 Claims, 3 Drawing Sheets

(51) Int. Cl.
*G09G 3/3233* (2016.01)
*G09G 3/3208* (2016.01)

(52) U.S. Cl.
CPC ... *G09G 3/3233* (2013.01); *G09G 2300/0819* (2013.01); *G09G 2320/0233* (2013.01); *G09G 2320/0626* (2013.01)

(58) Field of Classification Search
USPC ..... 345/204
See application file for complete search history.

(56) References Cited

U.S. PATENT DOCUMENTS

| | | | | |
|---|---|---|---|---|
| 2008/0315759 | A1* | 12/2008 | Chung | G09G 3/3233 313/504 |
| 2013/0120659 | A1 | 5/2013 | Park et al. | |
| 2013/0249883 | A1* | 9/2013 | Hwang | G09G 3/3275 345/212 |
| 2015/0138181 | A1* | 5/2015 | Hwang | H04N 13/341 345/212 |
| 2016/0190228 | A1* | 6/2016 | Park | H01L 27/3276 257/40 |
| 2016/0247453 | A1* | 8/2016 | Hwang | G09G 3/003 |
| 2018/0090064 | A1* | 3/2018 | Liu | G09G 3/3208 |
| 2018/0342205 | A1* | 11/2018 | Wang | H01L 51/5206 |
| 2021/0134246 | A1 | 5/2021 | Li et al. | |
| 2021/0150986 | A1 | 5/2021 | Li et al. | |

FOREIGN PATENT DOCUMENTS

| | | | |
|---|---|---|---|
| CN | 113327535 | A | 8/2021 |
| CN | 113450693 | A | 9/2021 |

* cited by examiner

| ELVSS/V | -3 | -3.1 | -3.2 | -3.3 | -3.4 | -3.5 | -3.6 | -3.7 | -3.8 | -3.9 | -4 |
|---|---|---|---|---|---|---|---|---|---|---|---|
| V1(Data)/V | 0.02 | 0.02 | 0.02 | 0.02 | 0.02 | 0.02 | 0.02 | 0.02 | 0.02 | 0.02 | 0.02 |
| V2(Data)/V | 0 | 0.03 | 0.03 | 0.015 | 0.01 | 0.01 | 0.02 | 0.03 | 0.02 | 0.02 | 0.03 |

OLED DISPLAY DEVICE AND BRIGHTNESS DRIVING METHOD THEREOF

CROSS REFERENCE TO RELATED APPLICATIONS

This application is a National Phase of PCT Patent Application No. PCT/CN2022/079663 having International filing date of Mar. 8, 2022, which claims the benefit of priority of Chinese Patent Application No. 202210139962.X, filed Feb. 16, 2022, the contents of which are all incorporated herein by reference in their entirety.

FIELD OF INVENTION

The present application relates to a field of display technologies, especially to an organic light emitting diode (OLED) display device and a brightness driving method thereof.

BACKGROUND OF INVENTION

To offer excellent use experiences to a user, display brightness value (DBV) of brightness of an organic light emitting diode (OLED) display panel in an electronic apparatus can be adjusted in advance, for example, by value range a of a predetermined display brightness value, a user can adjust brightness of the display panel by changing the of the OLED display panel. For example, when light is strong, a user can increase the DBV of the OLED display panel such that a user can clearly watch contents displayed on the OLED display panel. When light is weak, the user can reduce the DBV of the OLED display panel to prevent an excessive brightness difference between ambient light and the display panel causing pain of the user' eyes.

At present, with gradually raising demands to display of an OLED product, for example, an OLED display panel is required to have brightness approximating 1000 nit under a high brightness mode (HBM). To achieve the high brightness, a voltage difference between a normal mode and the HBM mode becomes greater. At present, generally a function of dynamic electro luminescence source supply voltage (ELVSS) is used to implement step variation of brightness. For example, the cathode voltage ELVSS of the OLED display panel is divided into several voltage intervals according to different DBV intervals. When a user switches the DBV, the cathode voltage ELVSS increases or decreases based on a unit of the voltage interval to achieve the step variation of the brightness.

However, because the power integrated circuit (IC) limits an output to a minimum step (span) of 0.1V, namely, a minimum voltage interval of the ELVSS is 0.1V, corresponding brightness has a large span such that brightness has sudden large variation when a client switches the DBV, which results in poor user experiences.

SUMMARY OF INVENTION

Technical Issue

The present application provides an OLED display device and a brightness driving method therefore such that during adjustment of the display brightness value, a data driving unit outputs different data voltages to the display panel according to whether the display brightness value is equal to the display brightness value configured to correspond to a voltage switch point such that a brightness difference between any adjacent two of display brightness value is within a predetermined range to prevent brightness jump.

Technical Solution

In a first aspect, the present application provides an organic light emitting diode (OLED) display device, comprising:

a display panel;

a display brightness value adjustment unit electrically connected to the display panel, configured to adjusting a display brightness value within a predetermined display brightness value interval; wherein a predetermined cathode voltage interval of the display panel configured to correspond to the predetermined display brightness value interval, and the predetermined cathode voltage interval comprises at least one voltage switch point; and a data driving unit electrically connected to the display panel and the display brightness value adjustment unit, configured to receive the display brightness value, and output different data voltages to the display panel according to whether the display brightness value is equal to the display brightness value configured to correspond to the voltage switch point such that a brightness difference between any adjacent two of the display brightness values is within a predetermined range.

In the OLED display device provided by the present application, the data driving unit outputs a compensation data voltage configured to correspond to the voltage switch point to the display panel when the display brightness value is equal to the display brightness value configured to correspond to the voltage switch point; and if not, the data driving unit outputs an initial data voltage to the display panel.

In the OLED display device provided by the present application, the data driving unit comprises:

an identification module electrically connected to the display brightness value adjustment unit and is configured to receive the display brightness value, determine whether the display brightness value is equal to the display brightness value configured to correspond to the voltage switch point, and output a compensation signal when the display brightness value is equal to the display brightness value configured to correspond to the voltage switch point; and a data voltage compensation module connected to the identification module, configured to receive the compensation signal, and generate the compensation data voltage according to the compensation signal.

In the OLED display device provided by the present application, the data voltage compensation module comprises a digital-analog converter (DAC) voltage module.

In the OLED display device provided by the present application, the display device further comprises a compensation data storage unit electrically connected to the data driving unit, configured to store a compensation data look-up table; wherein the compensation data look-up table comprises a data voltage compensation value configured to correspond to the voltage switch point; and wherein the data driving unit obtains from a data voltage compensation value configured to correspond to the voltage switch point the compensation data look-up table, and generates the compensation data voltage according to the data voltage compensation value when the display brightness value is equal to the display brightness value configured to correspond to the voltage switch point.

In the OLED display device provided by the present application, the predetermined cathode voltage interval is divided into a plurality of cathode voltage sub-intervals by the at least one switch point, and a voltage difference between end points of each of the cathode voltage sub-intervals is equal to a predetermined voltage value;

wherein the compensation data look-up table comprises a data voltage compensation value corresponding to the end points of each of the cathode voltage sub-intervals.

In the OLED display device provided by the present application, the predetermined voltage value is equal to 0.1V.

In the OLED display device provided by the present application, a relationship between a voltage of the end points of each of the cathode voltage sub-intervals and the data voltage compensation value corresponding to the voltage is indicated by a formula as follow:

$$V=aX+b;$$

wherein V is the data voltage compensation value, X is the voltage of the end points of the cathode voltage sub-interval, and a and b are constants.

In the OLED display device provided by the present application, a brightness range corresponding to the predetermined display brightness value interval ranges from 500 nit to 800 nit.

In the OLED display device provided by the present application, the data driving unit comprises a data driver integrated circuit (IC).

In a second aspect, the present application also provides an OLED display device brightness driving method, comprising steps as follows:

adjusting the display brightness value within the predetermined display brightness value interval; and receiving the display brightness value, and outputting different data voltages to the display panel according to whether the display brightness value is equal to the display brightness value configured to correspond to the voltage switch point such that a brightness difference between any adjacent two of the display brightness values is within a predetermined range.

In the OLED display device brightness driving method provided by the present application, the step of generating the different data voltages to the display panel according to whether the display brightness value is equal to the display brightness value configured to correspond to the voltage switch point, comprises steps as follows:

outputting a compensation data voltage configured to correspond to the voltage switch point to the display panel when the display brightness value is equal to the display brightness value configured to correspond to the voltage switch point;

if not, outputting an initial data voltage to the display panel.

In the OLED display device brightness driving method provided by the present application, the data driving unit comprises an identification module and a data voltage compensation module;

wherein the identification module is electrically connected to the display brightness value adjustment unit, is configured to receive the display brightness value, and determines whether the display brightness value is equal to the display brightness value configured to correspond to the voltage switch point, and output a compensation signal when the display brightness value is equal to the display brightness value configured to correspond to the voltage switch point; and wherein the data voltage compensation module is electrically connected to the identification module, is configured to receive the compensation signal and generate the compensation data voltage according to the compensation signal.

In the OLED display device brightness driving method provided by the present application, the data voltage compensation module comprises a digital-analog converter (DAC) voltage module.

In the OLED display device brightness driving method provided by the present application, the step of outputting to the compensation data voltage configured to correspond to the voltage switch point the display panel when the display brightness value is equal to the display brightness value configured to correspond to the voltage switch point, comprises steps as follows:

providing a compensation data look-up table, wherein the compensation data look-up table comprises a data voltage compensation value configured to correspond to the voltage switch point; and when the display brightness value is equal to the display brightness value configured to correspond to the voltage switch point, obtaining a data voltage compensation value configured to correspond to the voltage switch point from the compensation data look-up table, generating the compensation data voltage according to the data voltage compensation value, and outputting the compensation data voltage to the display panel.

In the OLED display device brightness driving method provided by the present application, the display device further comprises a compensation data storage unit electrically connected to the data driving unit and configured to store the compensation data look-up table.

In the OLED display device brightness driving method provided by the present application, the predetermined cathode voltage interval is divided into a plurality of cathode voltage sub-intervals by the at least one switch point, and a voltage difference between end points of each of the cathode voltage sub-intervals is equal to predetermined voltage value; and wherein the compensation data look-up table comprises a data voltage compensation value corresponding to the end points of each of the cathode voltage sub-intervals.

In the OLED display device brightness driving method provided by the present application, the predetermined voltage value is equal to 0.1V.

In the OLED display device brightness driving method provided by the present application, a relationship between a voltage of the end points of each of the cathode voltage sub-intervals and the data voltage compensation value corresponding to the voltage is indicated by a formula as follow:

$$V=aX+b;$$

wherein V is the data voltage compensation value, X is the voltage of the end points of the cathode voltage sub-interval, and a and b are constants.

In the OLED display device brightness driving method provided by the present application, a brightness range corresponding to the predetermined display brightness value interval ranges from 500 nit to 800 nit.

Advantages

Compared to the conventional technologies, the OLED display device and the brightness driving method thereof provided by the present application, during adjustment of the display brightness value, has the data driving unit receiving a display brightness value in real time, and outputting different data voltages to the display panel according to whether the display brightness value is equal to the display brightness value configured to correspond to a voltage switch point such that a brightness difference between any adjacent two of display brightness value is within a predetermined range to make brightness of the brightness interval (for example, the normal mode to the HBM mode interval) corresponding to the predetermined display brightness value interval change more finely to prevent brightness jump. Furthermore, a responsive time of the brightness is faster when a user switches the brightness display value to a target brightness display value, which effectively increases a display effect, and improves the user's experience.

DETAILED DESCRIPTION OF PREFERRED EMBODIMENTS

Figure 1:
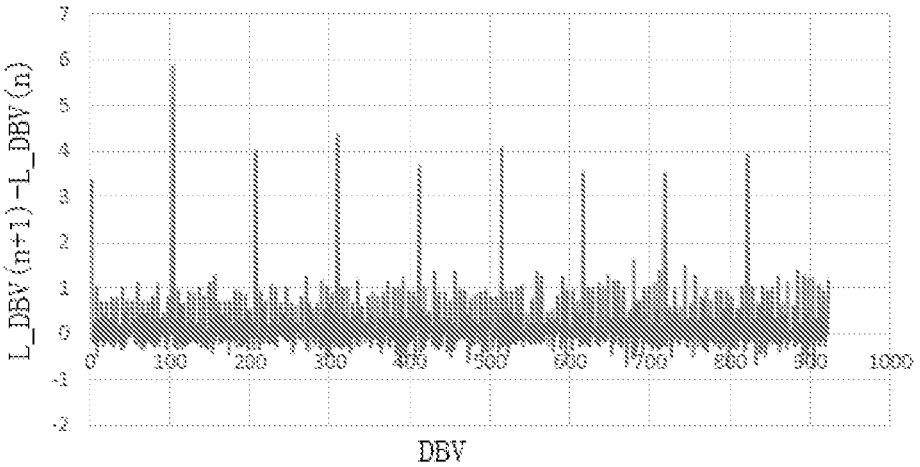
FIG. 1 is a schematic chart of a variation relationship between brightness differences and display brightness values of adjacent display brightness values of an exemplary OLED display device.

The technical solution in the embodiment of the present application will be clearly and completely described below with reference to the accompanying drawings in the embodiments of the present application. Apparently, the described embodiments are merely some embodiments of the present application instead of all embodiments. According to the embodiments in the present application, all other embodiments obtained by those skilled in the art without making any creative effort shall fall within the protection scope of the present application.

In the description of the present application, it should be noted that unless clear rules and limitations otherwise exist, terminologies "install", "connect", "connection" should be understood in a broad sense. For instance, the connection can be a fixed connection, a detachable connection or an integral connection. The connection can be a mechanical connection, an electrical connection or a telecommunication. The connection can be a direct connection, an indirect connection through an intermedium, can be an internal communication between two elements or an interaction between the two elements. For a person of ordinary skill in the art, the specific meaning of the above terminology in the present application can be understood on a case-by-case basis.

The following disclosure provides many different embodiments or examples to achieve different structures of the present application. To simplify the disclosure of the present application, the components and arrangements of the specific examples are described below. Of course, they are merely examples, and the purpose is not to limit the present application. Furthermore, the present application may repeat reference numerals and/or reference letters in different examples. The repetition is for the purpose of simplification and clarity, and does not by itself indicate the relationship between the various embodiments and/or settings discussed. In addition, the present application provides examples of various specific processes and materials, but a person of ordinary skill in the art can be aware of the application of other processes and/or the use of other materials.

Usually, brightness of a display panel can be adjusted by adjusting a display brightness value (DBV) in a predetermined DBV interval, the predetermined DBV interval corresponds to a brightness interval of the display panel. switching the brightness of the display panel from a normal mode (for example, the brightness is 500 nit) to a HBM mode (for example, the brightness is 800 nit) is implemented by switching from a DBV(n) (corresponding to 500 nit) to a DBV(m) (corresponding to 800 nit). However, with reference to FIG. 1, during switching from the DBV(n) to the DBV(m), a brightness difference (L_DBV(n+1)−L_DBV(n)) between adjacent display brightness values presents a plurality of "protrusion" brightness jumps, which results in poor user's experience. "Protrusion" brightness jump occurs because the brightness interval adjusts light through direct current (DC), organic light emitting diode (OLED) cathode voltage (ELVSS), as one of variables, has a voltage switch point (or called voltage variation node) when varying in the brightness interval. For example, when the ELVSS varies in an interval of −3 v to −4 v, a minimum voltage variation span is 0.1V. Therefore, the interval of −3 v to −4 v has nine voltage switch points (each voltage switch point corresponds to a switch point voltage), and during variation of the brightness, "protrusion" brightness jump occurs at the voltage switch point.

For the above issues, the present application provides an organic light emitting diode (OLED) display device and a brightness driving method thereof, achieving compensation to brightness corresponding to the voltage switch point by compensating a data voltage corresponding to a voltage switch point of a predetermined cathode voltage interval such that difference fluctuation of a brightness difference between adjacent DBVs is small and the brightness of the predetermined brightness interval (for example, from the normal mode to the HBM mode interval) varies more finely, which improves a display effect and user's experience. Specific descriptions are as the following embodiments.

Figure 2:
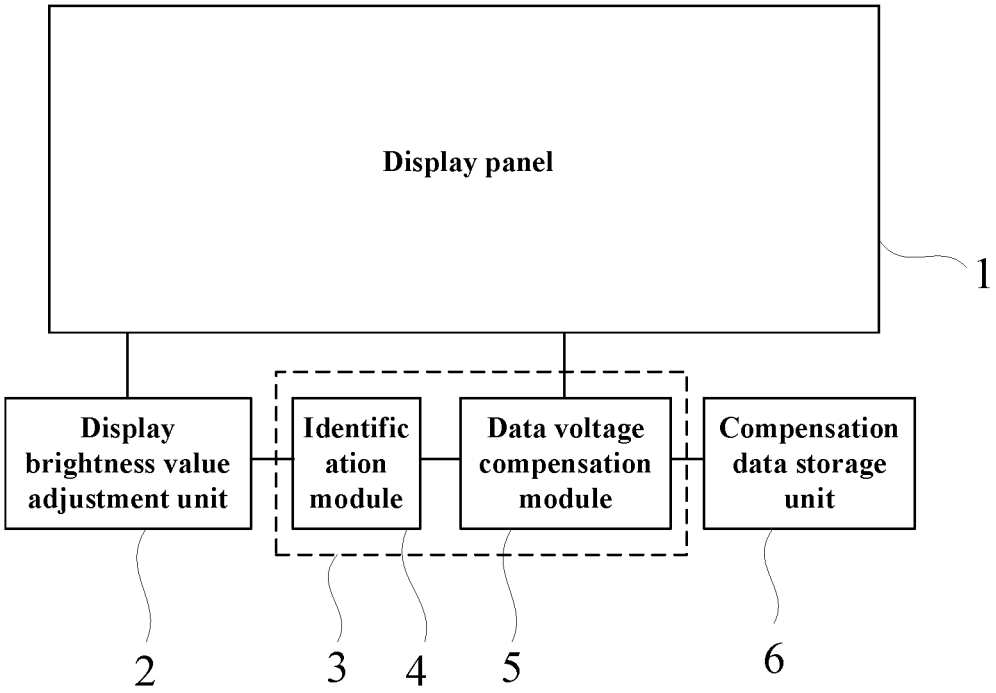
FIG. 2 is a schematic view of an OLED display device provided by the embodiment of the present application.

With reference to FIG. 2, the embodiment of the present application provides an OLED display device, the OLED display device comprising a display panel 1, a display brightness value adjustment unit 2 and a data driving unit 3. The display brightness value adjustment unit 2 is electrically connected to the display panel 1, is configured to adjust a display brightness value within a predetermined display brightness value interval. wherein a predetermined cathode voltage interval of the display panel 1 is configured to correspond to a predetermined display brightness value interval, and the predetermined cathode voltage interval comprises at least one voltage switch point. The data driving unit 3 is electrically connected to the display panel and the display brightness value adjustment unit 2, is configured to receive a display brightness value, and outputs different data voltages to the display panel 1 according to whether the display brightness value is equal to the display brightness value configured to correspond to a voltage switch point such that a brightness difference between any adjacent two of display brightness value is within a predetermined range.

In particular, when display brightness value is equal to the display brightness value configured to correspond to the voltage switch point, the data driving unit 3 outputs a compensation data voltage to the display panel 1 corresponding to the voltage switch point; if not, the data driving unit 3 output an initial data voltage s to the display panel 1.

It can be understood that an initial data voltage is different from a compensation data voltage in value. In a specific embodiment, the compensation data voltage is a data voltage after the initial data voltage is compensated. Namely, a process of the data driving unit 3 outputting the compensation data voltage configured to correspond to the voltage switch point to the display panel 1, is actually a process of compensating brightness corresponding to a voltage switch point, and a process of obtaining the compensation data voltage is actually a process of compensating the data voltage corresponding to the voltage switch point.

In particular, when the voltage switch point of the predetermined cathode voltage interval is plurali, display brightness value is equal to a display brightness value configured to correspond to any one of the voltage switch points, the data driving unit 3 outputs a compensation data voltage configured to correspond to the voltage switch point to the display panel 1.

In particular, in the predetermined display brightness value interval, each display brightness value corresponds to one brightness, Adjusting the display brightness value can adjust the brightness of the display panel 1. In a specific embodiment, brightness value adjustment unit can be a brightness bar, a user can drag the brightness bar to switch the display brightness value to adjust the brightness of the display panel 1. Of course, the present application has no limit to the specific structures of the brightness value adjustment unit.

In a specific embodiment, a brightness range of the predetermined display brightness value interval is from 500 nit to 800 nit. It can be understood that adjusting the brightness from 500 nit to 800 nit means adjusting the brightness from the normal mode to the HBM mode such that the display panel is finally in a high brightness state.

In particular, the predetermined cathode voltage interval is configured to correspond to the predetermined display brightness value interval, the predetermined cathode voltage interval is divided by at least one voltage switch point into a plurality of cathode voltage sub-intervals, and a voltage difference of end points of each of the cathode voltage sub-intervals is equal to predetermined voltage value, for example, 0.1V. Because the predetermined display brightness value interval is configured to correspond to the predetermined cathode voltage interval, the predetermined display brightness value interval can also be divided into a plurality of brightness display value sub-intervals corresponding to the cathode voltage sub-intervals. It should be explained that cathode voltage sub-intervals is a minimum unit that the cathode voltage switches by. For example, cathode voltage can only increase or decrease by a unit of 0.1V. Each of the brightness display value sub-intervals further comprises a plurality of brightness display value set in an increasing sequence, and each of the display brightness values corresponds to one brightness.

In particular, the data driving unit 3 can be a data driver integrated circuit (IC).

In a specific embodiment, the data driving unit 3 comprises an identification module 4 and a data voltage compensation module 5. The identification module 4 is electrically connected to the display brightness value adjustment unit 2, is configured to receive the display brightness value, determine whether the display brightness value is equal to the display brightness value configured to correspond to a voltage switch point, and emit a compensation signal when display brightness value is equal to the display brightness value configured to correspond to the voltage switch point. The data voltage compensation module 5 is connected to the identification module 4, is configured to receive the compensation signal and generate a compensation data voltage according to compensation signal.

In particular, when a user adjusts the display brightness value (DBV) within the predetermined display brightness value interval by the display brightness value adjustment unit 2, the identification module 4 receives the display brightness value in real time, and determines whether the display brightness value received is equal to the display brightness value configured to correspond to a voltage switch point. It can be understood that because the identification module 4 receives the display brightness value and makes determination in real time, the data voltage compensation module 5 can timely generate a compensation data voltage corresponding to the voltage switch point and output the compensation data voltage to the display panel such that when the brightness display value is adjusted within the predetermined brightness display value interval, the brightness corresponding to the voltage switch point can be renewed (compensation) in real time to prevent brightness jump.

In particular, the data voltage compensation module 5 can be a digital-analog converter (DAC) voltage module disposed in the data driver IC.

In particular, the data voltage compensation module 5 generates a compensation data voltage in a blanking interval between two frames such that the display panel 1 can display with the compensation data voltage at a next frame to achieve renew of the brightness.

In particular, the OLED display device further comprises a compensation data storage unit 6 electrically connected to the data driving unit 3 and configured to store a compensation data look-up table LUT. The compensation data look-up table LUT comprises two end points of the predetermined cathode voltage interval, a plurality of voltage switch points within the predetermined cathode voltage interval, and a plurality of data voltage compensation values corresponding to the end points of predetermined cathode voltage interval and the voltage switch points. When the display brightness value is equal to the display brightness value configured to correspond to the voltage switch point, the data driving unit 3 obtains the data voltage compensation value configured to correspond to the voltage switch point from the compensation data look-up table and generates a compensation data voltage according to data voltage compensation value.

In particular, the compensation data look-up table LUT in the compensation data storage unit 6 can be acquired during manufacturing the display panel. In particular, during a test to brightness of the display panel, an external detection module detects the cathode voltage of the display panel in real time, and the data voltage of the voltage switch point is compensated when the cathode voltage is detected to be equal to a voltage of the voltage switch point of the predetermined cathode voltage interval such that a brightness difference between any adjacent two of display brightness value is within a predetermined range to determine a data voltage compensation value corresponding to the voltage switch point. After the test completes, the obtained data voltage compensation value of all voltage switch points are stored in form of a compensation data look-up table LUT to the compensation data storage unit 6 such that a data voltage compensation value required can be called in time during use of a terminal product.

In particular, the compensation data storage unit 6 can be an erasable Flash IC, and can be an EEPROM IC or a driver IC with a greater ROM. The compensation data storage unit 6 is in communication and connection with the data voltage compensation module 5.

In particular, a relationship between the end points and the voltage switch points of the predetermined cathode voltage interval and corresponding data voltage compensation values is determined by characteristics of the display panel. It can be understood that the end points of the cathode voltage sub-intervals constitute the end points and the voltage switch points of the predetermined cathode voltage interval.

In a specific embodiment, in the compensation data look-up table LUT, a relationship between a voltage of end points of each of the cathode voltage sub-intervals and a corresponding data voltage compensation value is indicated by a formula as follows:

$$V=aX+b;$$

wherein V is the data voltage compensation value, X is the voltage of the end points of the cathode voltage sub-interval (namely, cathode voltage ELVSS), a and b are constants.

Figures 3, 4:
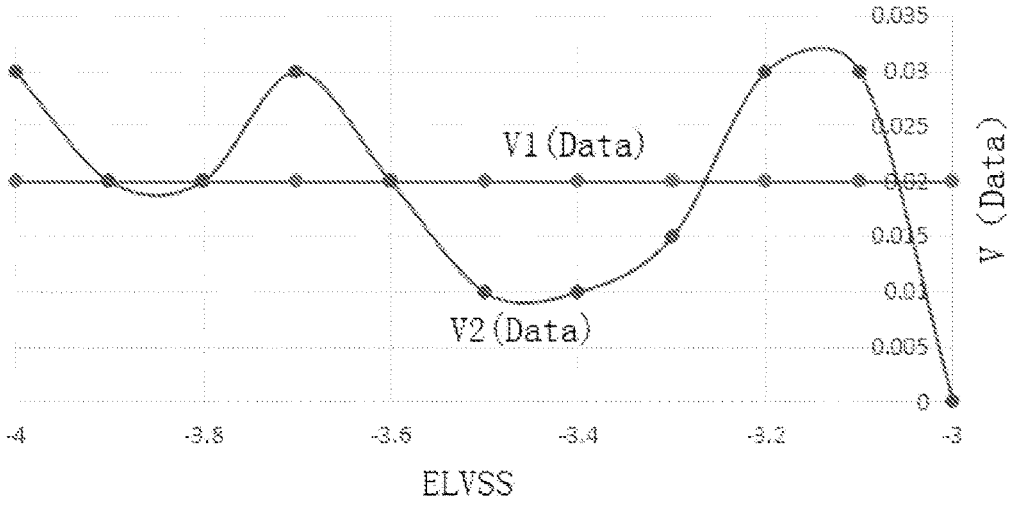
FIG. 3 is a compensation data look-up table provided by the embodiment of the present application.
FIG. 4 is a schematic chart of a relationship between data voltage compensation values and cathode voltages of the compensation data look-up table provided in FIG. 3.

For example, FIG. 3 illustrates a compensation data look-up table for a display panel of two different display panel characteristics. FIG. 4 is a schematic chart of a relationship between the data voltage compensation value and the cathode voltage in the compensation data look-up table provided by FIG. 3. V1(Data) and V2(Data) in the compensation data look-up table are data voltage compensation values of the display panel of the two different display panel characteristics. The predetermined cathode voltage interval is [−4V, −3V], nine voltage switch points divide the predetermined cathode voltage interval into ten cathode voltage sub-intervals, and a voltage difference between end points of each voltage sub-interval is 0.1V. A voltage (i.e., cathode voltage) of end points of each of the cathode voltage sub-intervals is configured to have V1(Data) and one V2(Data).

When the display brightness value received by the data driving unit 3 is equal to the display brightness value configured to correspond to one voltage switch point (for example, −3.1V) of the compensation data look-up table as shown in FIG. 3, the data driving unit 3 obtain the data voltage compensation value (for example, data voltage compensation value configured to correspond to −3.1V is 0.02 or 0.03) configured to correspond to the voltage switch point directly from the compensation data look-up table, and generates a compensation data voltage according to data voltage compensation value.

Figure 5:
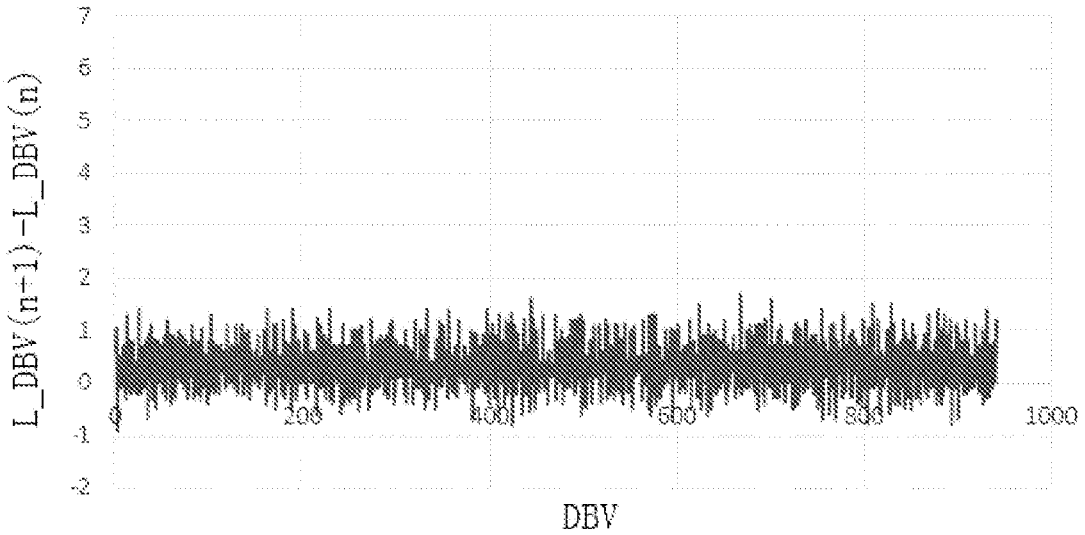
FIG. 5 is a schematic chart of a variation relationship between brightness differences and display brightness values of adjacent display brightness values of an OLED display device provided by the embodiment of the present application.

With reference to FIG. 5, in any one of the above embodiments, when the brightness is adjusted between the normal mode and the HBM mode interval, the brightness difference between any adjacent two of brightness display value is within a predetermined range such that a variation range of the brightness difference (L_DBV(n+1)−L_DBV(n)) between adjacent display brightness values is small to prevent brightness jump.

In particular, the identification module 4, the data voltage compensation module 5, and the compensation data storage unit 6 can be integrated in the same driver integrated circuit (IC), of course, they can be disposed individually without limitations here.

In the embodiment of the present application, during adjustment of the display brightness value, the data driving unit 3 receives the display brightness value in real time. The data driving unit 3 outputs a compensation data voltage configured to correspond to the voltage switch point to the display panel 1 when display brightness value is equal to the display brightness value configured to correspond to the voltage switch point. If not, the data driving unit 3 outputs an initial data voltage to the display panel 1 to achieve compensation to the brightness of the voltage switch point such that a brightness difference between any adjacent two of display brightness value is within a predetermined range such that the brightness of the predetermined brightness interval (for example, from the normal mode to the HBM mode interval) varies more finely to prevent brightness jump. Furthermore, a responsive time of the brightness is faster when a user switches the brightness display value to a target brightness display value, which effectively increases a display effect, and improves the user's experience.

Figure 6:
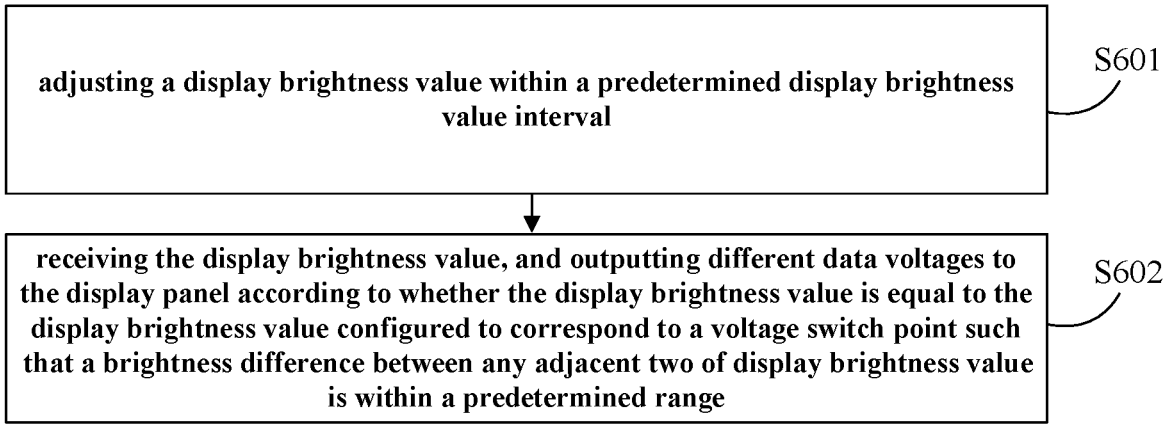
FIG. 6 is a schematic view of an OLED display device provided by the embodiment of the present application brightness driving method.

With reference to FIG. 6, the embodiment of the present application also provides an OLED display device brightness driving method applied to the above embodiment, the structures of the OLED display device refer to the above embodiment, and will not be described repeatedly here.

In particular, the brightness driving method of the embodiment of the present application comprises steps S601 to S602.

The S601 comprises: adjusting a display brightness value within a predetermined display brightness value interval.

In particular, the step S601 is completed by the display brightness value adjustment unit of the above embodiment.

In particular, in the predetermined display brightness value interval, each display brightness value corresponds to one brightness. Adjusting the display brightness value can adjust the brightness of the display panel. In a specific embodiment, brightness value adjustment unit can be a brightness bar, and a user can drag the brightness bar on the display panel to switch the display brightness value to adjust the brightness of the display panel.

In a specific embodiment, a brightness range of the predetermined display brightness value interval is from 500 nit to 800 nit. It can be understood that adjusting the brightness from 500 nit to 800 nit means adjusting the brightness from the normal mode to the HBM mode such that the display panel is finally in a high brightness state.

The S602 comprises: receiving the display brightness value, and outputting different data voltages to the display panel according to whether the display brightness value is equal to the display brightness value configured to correspond to a voltage switch point such that a brightness difference between any adjacent two of display brightness value is within a predetermined range.

In particular, step S602 is completed by the data driving unit of the above embodiment. Specific descriptions of the data driving unit refers to the above embodiment, and will not be described repeatedly here.

In particular, the predetermined cathode voltage interval is configured to correspond to the predetermined display brightness value interval, the predetermined cathode voltage interval is divided by at least one voltage switch point into a plurality of cathode voltage sub-intervals, and a voltage difference of end points of each of the cathode voltage sub-intervals is equal to predetermined voltage value, for example, 0.1V. Because the predetermined display brightness value interval is configured to correspond to the predetermined cathode voltage interval, the predetermined display brightness value interval can also be divided into a plurality of brightness display value sub-intervals corresponding to the cathode voltage sub-intervals. It should be explained that cathode voltage sub-intervals is a minimum unit that the cathode voltage switches by. For example, cathode voltage can only increase or decrease by a unit of 0.1V. Each of the brightness display value sub-intervals further comprises a plurality of brightness display value set in an increasing sequence, and each of the display brightness values corresponds to one brightness.

In particular, in the step S602, the step of outputting the different data voltages to the display panel according to whether the display brightness value is equal to the display brightness value configured to correspond to a voltage switch point, comprises steps as follows:

when display brightness value is equal to the display brightness value configured to correspond to the voltage switch point, outputting a compensation data voltage configured to correspond to the voltage switch point to the display panel;

if not, outputting an initial data voltage to the display panel.

In a specific embodiment, the data driving unit comprises an identification module electrically connected to the display brightness value adjustment unit and a data voltage compensation module electrically connected to the identification module. The identification module receives the display brightness value, and determines whether the display brightness value is equal to the display brightness value configured to correspond to a voltage switch point, and emits a compensation signal when display brightness value is equal to the display brightness value configured to correspond to the voltage switch point. The data voltage compensation module receives the compensation signal and generates a compensation data voltage according to compensation signal.

In particular, the above when display brightness value is equal to the display brightness value configured to correspond to the voltage switch point, outputting a compensation data voltage configured to correspond to the voltage switch point to the display panel, comprises steps as follows:

providing a compensation data look-up table, wherein the compensation data look-up table comprises a data voltage compensation value configured to correspond to the voltage switch point;

when display brightness value is equal to the display brightness value configured to correspond to the voltage switch point, obtaining the data voltage compensation value configured to correspond to the voltage switch point from the compensation data look-up table, generating a compensation data voltage according to data voltage compensation value and outputting the compensation data voltage to the display panel.

In particular, the compensation data look-up table LUT is stored in a compensation data storage unit, specific descriptions about the compensation data storage unit refer to the above embodiment, and will not be described repeatedly here.

In the embodiment of the present application, during adjustment of the display brightness value. The data driving unit receives the display brightness value in real time, when display brightness value is equal to the display brightness value configured to correspond to the voltage switch point, the data driving unit outputs a compensation data voltage configured to correspond to the voltage switch point to the display panel. If not, the data driving unit outputs an initial data voltage to the display panel to achieve compensation to the brightness corresponding to the voltage switch point such that the brightness difference between any adjacent two of display brightness value is within a predetermined range such that the brightness of the predetermined brightness interval (for example, from the normal mode to the HBM mode interval) varies more finely to prevent brightness jump. Furthermore, a responsive time of the brightness is faster when a user switches the brightness display value to a target brightness display value, which effectively increases a display effect, and improves the user's experience.

In the above-mentioned embodiments, the descriptions of the various embodiments are focused. For the details of the embodiments not described, reference may be made to the related descriptions of the other embodiments.

The OLED display device and the brightness driving method thereof provided by the embodiments of the present application are described in detail as above. The principles and implementations of the present application are described in the following by using specific examples. The description of the above embodiments is only for assisting understanding of the technical solutions of the present application and the core ideas thereof. Those of ordinary skill in the art should understand that they can still modify the technical solutions described in the foregoing embodiments are or equivalently replace some of the technical features. These modifications or replacements do not depart from the essence of the technical solutions of the embodiments of the present application.

What is claimed is:

1. An OLED display device, comprising:

a display panel;

a display brightness value adjustment unit electrically connected to the display panel, configured to adjusting a display brightness value within a predetermined display brightness value interval; wherein a predetermined cathode voltage interval of the display panel configured to correspond to the predetermined display brightness value interval, and the predetermined cathode voltage interval comprises at least one voltage switch point; and a data driving unit electrically connected to the display panel and the display brightness value adjustment unit, configured to receive the display brightness value, and output different data voltages to the display panel according to whether the display brightness value is equal to the display brightness value configured to correspond to the voltage switch point such that a brightness difference between any adjacent two of the display brightness values is within a predetermined range;

wherein, the data driving unit outputs a compensation data voltage configured to correspond to the voltage switch point to the display panel when the display brightness value is equal to the display brightness value configured to correspond to the voltage switch point; and if not, the data driving unit outputs an initial data voltage to the display panel.

2. The OLED display device according to claim 1, wherein the data driving unit comprises:

an identification module electrically connected to the display brightness value adjustment unit and is configured to receive the display brightness value, determine whether the display brightness value is equal to the display brightness value configured to correspond to the voltage switch point, and output a compensation signal when the display brightness value is equal to the display brightness value configured to correspond to the voltage switch point; and a data voltage compensation module connected to the identification module, configured to receive the compensation signal, and generate the compensation data voltage according to the compensation signal.

3. The OLED display device according to claim 2, wherein the data voltage compensation module comprises a digital-analog converter (DAC) voltage module.

4. The OLED display device according to claim 1, wherein the display device further comprises a compensation data storage unit electrically connected to the data driving unit, configured to store a compensation data look-up table; wherein the compensation data look-up table comprises a data voltage compensation value configured to correspond to the voltage switch point; and wherein the data driving unit obtains from a data voltage compensation value configured to correspond to the voltage switch point the compensation data look-up table, and generates the compensation data voltage according to the data voltage compensation value when the display brightness value is equal to the display brightness value configured to correspond to the voltage switch point.

5. The OLED display device according to claim 4, wherein the predetermined cathode voltage interval is divided into a plurality of cathode voltage sub-intervals by the at least one switch point, and a voltage difference between end points of each of the cathode voltage sub-intervals is equal to a predetermined voltage value;

wherein the compensation data look-up table comprises a data voltage compensation value corresponding to the end points of each of the cathode voltage sub-intervals.

6. The OLED display device according to claim 5, wherein the predetermined voltage value is equal to 0.1V.

7. The OLED display device according to claim 5, wherein a relationship between a voltage of the end points of each of the cathode voltage sub-intervals and the data voltage compensation value corresponding to the voltage is indicated by a formula as follow:

$$V=aX+b;$$

wherein V is the data voltage compensation value, X is the voltage of the end points of the cathode voltage sub-interval, and a and b are constants.

8. The OLED display device according to claim 1, wherein a brightness range corresponding to the predetermined display brightness value interval ranges from 500 nit to 800 nit.

9. The OLED display device according to claim 1, wherein the data driving unit comprises a data driver integrated circuit (IC).

10. A OLED display device brightness driving method, comprising steps as follows:

providing the OLED display device according to claim 1;

adjusting the display brightness value within the predetermined display brightness value interval; and receiving the display brightness value, and outputting different data voltages to the display panel according to whether the display brightness value is equal to the display brightness value configured to correspond to the voltage switch point such that a brightness difference between any adjacent two of the display brightness values is within a predetermined range;

wherein the step of generating the different data voltages to the display panel according to whether the display brightness value is equal to the display brightness value configured to correspond to the voltage switch point, comprises steps as follows:

outputting a compensation data voltage configured to correspond to the voltage switch point to the display panel when the display brightness value is equal to the display brightness value configured to correspond to the voltage switch point;

if not, outputting an initial data voltage to the display panel.

11. The OLED display device brightness driving method according to claim 10, wherein the data driving unit comprises an identification module and a data voltage compensation module;

wherein the identification module is electrically connected to the display brightness value adjustment unit, is configured to receive the display brightness value, and determines whether the display brightness value is equal to the display brightness value configured to correspond to the voltage switch point, and output a compensation signal when the display brightness value is equal to the display brightness value configured to correspond to the voltage switch point; and wherein the data voltage compensation module is electrically connected to the identification module, is configured to receive the compensation signal and generate the compensation data voltage according to the compensation signal.

12. The OLED display device brightness driving method according to claim 11, wherein the data voltage compensation module comprises a digital-analog converter (DAC) voltage module.

13. The OLED display device brightness driving method according to claim 10, wherein the step of outputting to the compensation data voltage configured to correspond to the voltage switch point the display panel when the display brightness value is equal to the display brightness value configured to correspond to the voltage switch point, comprises steps as follows:

providing a compensation data look-up table, wherein the compensation data look-up table comprises a data voltage compensation value configured to correspond to the voltage switch point; and when the display brightness value is equal to the display brightness value configured to correspond to the voltage switch point, obtaining a data voltage compensation value configured to correspond to the voltage switch point from the compensation data look-up table, generating the compensation data voltage according to the data voltage compensation value, and outputting the compensation data voltage to the display panel.

14. The OLED display device brightness driving method according to claim 13, wherein the display device further comprises a compensation data storage unit electrically connected to the data driving unit and configured to store the compensation data look-up table.

15. The OLED display device brightness driving method according to claim 13, wherein the predetermined cathode voltage interval is divided into a plurality of cathode voltage sub-intervals by the at least one switch point, and a voltage difference between end points of each of the cathode voltage sub-intervals is equal to predetermined voltage value; and wherein the compensation data look-up table comprises a data voltage compensation value corresponding to the end points of each of the cathode voltage sub-intervals.

16. The OLED display device brightness driving method according to claim 15, wherein the predetermined voltage value is equal to 0.1V.

17. The OLED display device brightness driving method according to claim 15, wherein a relationship between a voltage of the end points of each of the cathode voltage sub-intervals and the data voltage compensation value corresponding to the voltage is indicated by a formula as follow:

$$V=aX+b;$$

wherein V is the data voltage compensation value, X is the voltage of the end points of the cathode voltage sub-interval, and a and b are constants.

18. The OLED display device brightness driving method according to claim 10, wherein a brightness range corresponding to the predetermined display brightness value interval ranges from 500 nit to 800 nit.

* * * * *